US006657400B2

(12) United States Patent
Konopka et al.

(10) Patent No.: US 6,657,400 B2
(45) Date of Patent: Dec. 2, 2003

(54) BALLAST WITH PROTECTION CIRCUIT FOR PREVENTING INVERTER STARTUP DURING AN OUTPUT GROUND-FAULT CONDITION

(75) Inventors: John G. Konopka, Deer Park, IL (US); Sameer Sodhi, Vernon Hills, IL (US); Himamshu V. Prasad, Rolling Meadows, IL (US)

(73) Assignee: Osram Sylvania Inc., Danvers, MA (US)

( * ) Notice: Subject to any disclaimer, the term of this patent is extended or adjusted under 35 U.S.C. 154(b) by 3 days.

(21) Appl. No.: 10/198,878

(22) Filed: Jul. 19, 2002

(65) Prior Publication Data

US 2003/0062850 A1 Apr. 3, 2003

Related U.S. Application Data

(63) Continuation-in-part of application No. 09/967,192, filed on Sep. 28, 2001, now abandoned.

(51) Int. Cl.[7] ..... H05B 37/02

(52) U.S. Cl. ..... 315/224; 315/244; 315/DIG. 5

(58) Field of Search ..... 315/224, 244, 315/DIG. 5, DIG. 7

(56) References Cited

U.S. PATENT DOCUMENTS 4,663,571 A * 5/1987 Nilssen ..... 315/244

* cited by examiner

*Primary Examiner*—David Vu
(74) *Attorney, Agent, or Firm*—Kenneth D. Labudda

(57) ABSTRACT

A ballast (10) for powering a gas discharge lamp load includes an inverter (200) and a protection circuit (400) for preventing start up of the inverter (200) in response to a ground fault condition wherein one or more of the ballast output connections (302,306) is coupled to earth ground.

26 Claims, 6 Drawing Sheets

BALLAST WITH PROTECTION CIRCUIT FOR PREVENTING INVERTER STARTUP DURING AN OUTPUT GROUND-FAULT CONDITION

RELATED APPLICATIONS

This application is a continuation-in-part of application Ser. No. 09/967,192, filed Sep. 28, 2001 and entitled "Ballast with Protection Circuit for Preventing Inverter Startup During an Output Ground-Fault Condition", now abandoned.

FIELD OF THE INVENTION

The present invention relates to the general subject of circuits for powering discharge lamps. More particularly, the present invention relates to a ballast that includes a circuit for preventing start up of the inverter when one or more of the ballast output wires is shorted to earth ground.

BACKGROUND OF THE INVENTION

A number of existing electronic ballasts have non-isolated outputs. Such ballasts typically include circuitry for protecting the ballast inverter from damage in the event of lamp fault conditions such as lamp removal or lamp failure.

Occasionally, the output wiring of a ballast becomes shorted to earth ground in the lighting fixture. Such a condition can arise, for example, due to the wires becoming loose or pinched. For ballasts with non-isolated outputs, if the inverter begins to operate while an earth ground short is present at one or more of the output wires, a very large low frequency (e.g., 60 hertz) current will flow through the inverter transistors and cause them to fail.

Thus, a need exists for a ballast with a protection circuit that prevents the inverter from starting when an output ground-fault condition is present. A ballast with such a protection circuit would represent a significant advance over the prior art.

DETAILED DESCRIPTION OF THE PREFERRED EMBODIMENTS

Figure 1:
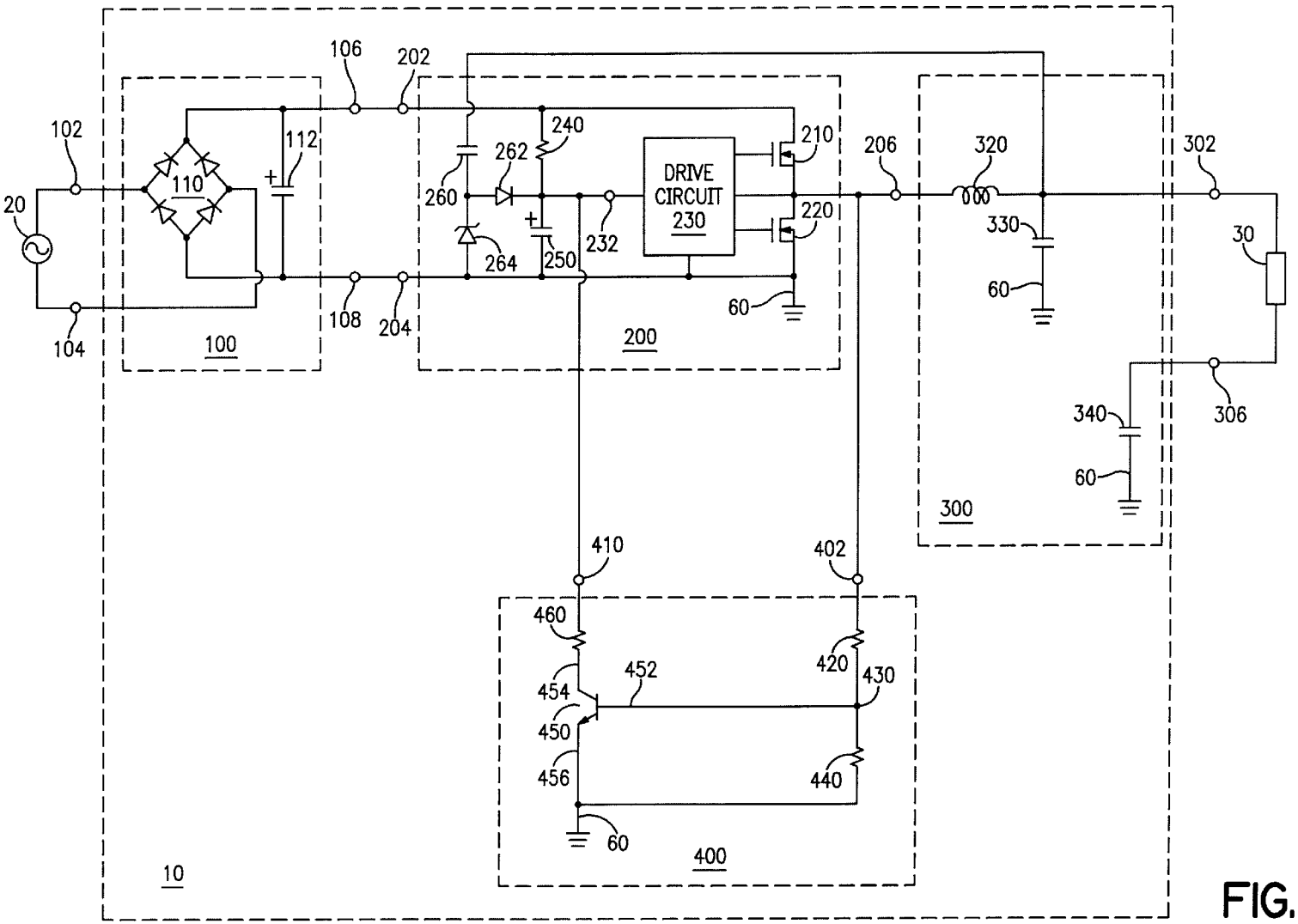
FIG. 1 describes a ballast with a half-bridge inverter and a protection circuit for preventing inverter start up during an output-to-ground fault involving a first output connection, in accordance with a first preferred embodiment of the present invention.

A first preferred embodiment of the present invention is described in FIG. 1. Ballast 10 includes a rectifier circuit 100, an inverter 200, an output circuit 300, and a protection circuit 400.

Rectifier circuit 100 has first and second input terminals 102,104 for receiving a source of conventional alternating current, such as 120 volts AC at 60 hertz, and first and second output terminals 106,108. Second output terminal 108 is coupled to a circuit ground node 60. Rectifier circuit 100 includes a full-wave diode bridge 110 and a capacitor 112. During operation, capacitor 112 is sufficiently large (e.g., on the order of tens of microfarads) such that a substantially direct current (DC) voltage is provided between output terminals 106,108. Alternatively, and as known in the prior art, a boost converter may be inserted between output terminals 106,108 and inverter 200 so as to provide power factor correction and other benefits, in which case capacitor 112 is selected to be relatively small (e.g., on the order of tenths of a microfarad) and the voltage between output terminals 106,108 is substantially unfiltered, full-wave rectified AC (i.e., "pulsating DC"). In either case, a substantially DC voltage is provided to inverter 200.

Significantly, the voltage that exists between second output terminal 108 and earth ground (or, equivalently, the voltage that exists between second output terminal 108 and second input terminal 104; second input terminal 104 is coupled to the neutral wire of AC source 20, which is at the same potential as earth ground) is low frequency (e.g., 60 hertz) half-wave rectified AC.

Inverter 200 includes first and second input terminals 202,204, an output terminal 206, first and second inverter switches 210,220, a drive circuit 230, and a DC supply circuit that includes resistor 240, capacitor 250, capacitor 260, diode 262, and a zener diode 264. First input terminal 202 is coupled to first output terminal 106 of rectifier circuit 100. Second input terminal 204 is coupled to second output terminal 108 of rectifier circuit 100. First inverter switch 210 is coupled between first input terminal 210 and output terminal 206. Second inverter switch 220 is coupled between output terminal 206 and circuit ground 60. As depicted in FIG. 1, inverter switches 210,220 are preferably implemented as field-effect transistors. Drive circuit 230 is coupled to inverter switches 210,220, and includes a DC supply input 232. Drive circuit 230 may be implemented using any of a number of circuits known to those skilled in the art, such as the IR2155 high-side driver integrated circuit manufactured by International Rectifier. Alternatively, although not explicitly shown or described in the drawings, drive circuit 230 may be implemented using any of a number of a self-oscillating drive arrangements known to those skilled in the art; for example, drive circuit 230 may include a diac-based start up circuit for initiating inverter operation and a feedback circuit that uses signals from output circuit 300 to provide inverter switching once the inverter begins to operate.

During operation, drive circuit 230 turns inverter switches 210,220 on and off in a substantially complementary fashion and preferably at a high frequency rate in excess of 20,000 hertz. Drive circuit 230 initially turns on when the voltage at DC supply input 232 exceeds a start up threshold (e.g., 10 volts), and remains on as long as the voltage at DC supply input 232 remains above a turn-off threshold (e.g., 8 volts). Resistor 240 and capacitor 250 are coupled to DC supply input 232 and provide energy for initially turning on drive circuit 230. Once inverter 200 begins to operate, energy from output circuit 300 is delivered, via capacitor 260 and diode 262, to capacitor 250 and drive circuit 230. This low-impedance "bootstrapping" circuit supplies the operating current required by drive circuit 230 and maintains the voltage across capacitor 250 at a value (e.g., 15 volts) well above the turn-off threshold (e.g., 8 volts) of drive circuit 230. Zener diode 264 protects drive circuit 230 from overvoltage and/or excessive power dissipation by ensuring that the voltage at DC supply input 230 does not exceed a specified level (e.g., 15 volts).

Output circuit 300 includes first and second output connections 302, 306, a resonant inductor 320, a resonant capacitor 330, and a direct current (DC) blocking capacitor 340. First and second output connections 302,306 are adapted for connection to a lamp load comprising at least one gas discharge lamp 30. Resonant inductor 320 is coupled between inverter output terminal 206 and first output connection 302. Resonant capacitor 330 is coupled between first output connection 302 and circuit ground 60. DC blocking capacitor 340 is coupled between second output connection 306 and circuit ground 60. During operation, resonant inductor 320 and resonant capacitor 330 function in a well-known manner as a series resonant circuit having a natural resonant frequency that is typically at or near the frequency at which inverter switches 210,220 are turned on and off. Output circuit 300 supplies a high voltage for igniting lamp 30, as well as a magnitude-limited current for operating lamp 30 in a controlled manner. DC blocking capacitor 300 blocks the DC component in the inverter output voltage (which is equal to half of the rectifier output voltage) and thus prevents substantial DC components from appearing in the voltage and current provided to lamp 30 during steady-state operation.

Protection circuit 400 includes an input 402 coupled to inverter output 206, and an output coupled to DC supply input 232 of drive circuit 230. During operation, protection circuit 400 prevents inverter 200 from starting if first output connection 302 is shorted to earth ground.

As described in FIG. 1, in a first preferred embodiment of the present invention, protection circuit 400 includes a first resistor 420, a second resistor 440, an electronic switch 450, and a third resistor 460. First resistor 420 is coupled between input 402 and a first node 430. Second resistor 440 is coupled between first node 430 and circuit ground 60. Electronic switch 450 is preferably implemented as a NPN bipolar junction transistor having a base 452, a collector 454, and an emitter 456. Base 452 is coupled to first node 430. Emitter 456 is coupled to circuit ground 60. Third resistor 460 is coupled between output 410 and the collector 454 of transistor 450.

In a prototype ballast configured substantially as shown in FIG. 1, the components of protection circuit 400, and selected components of the DC supply circuit of inverter 200, were sized as follows:

Resistor 240: 220 kilohms
Capacitor 250: 22 microfarads
Resistor 420: 220 kilohms
Resistor 440: 2.2 kilohms
Transistor 450: 2N3904
Resistor 460: 2.2 kilohms The detailed operation of protection circuit 400 is now explained with reference to FIG. 1 as follows. When AC power is initially applied to ballast 10, drive circuit 230 and inverter 200 are off and remain off until such time as the voltage at DC supply input 232 reaches the predetermined start up threshold (e.g., 10 volts) of drive circuit 230. In the absence of a ground fault condition at output connection 302, protection circuit 400 will exert no effect upon inverter start up because transistor 450 will be non-conductive prior to inverter start up. With transistor 450 off, capacitor 250 charges up via resistor 240. Once the voltage across capacitor 250 reaches the start up threshold (e.g., 10 volts), drive circuit 230 turns on and begins to turn inverter switches 210,220 on and off in a periodic manner.

At this point, with inverter 200 operating, the voltage between inverter output 206 and circuit ground 60 varies between zero and a high DC value (i.e., the DC voltage provided between inverter input terminals 202,204) at a high frequency rate, which causes two things to occur. First, the voltage at inverter output 206 excites output circuit 300. Consequently, bootstrapping energy is fed back from output circuit 300 to capacitor 250 and drive circuit 230 via capacitor 260 and diode 262, thereby keeping drive circuit 230 active. Second, during those intervals when the voltage at inverter output 206 is high, sufficient voltage is developed across resistor 440 to turn on transistor 450. Thus, transistor 450 turns on and off at a high frequency rate. However, this exerts no substantial effect on the operation of inverter 200 because, even with transistor 450 on and resistor 460 coupled to circuit ground 60, abundant bootstrapping current is provided to maintain the voltage at DC supply input 232 well above the turn-off threshold (e.g., 8 volts) of drive circuit 230; for this reason, resistor 460 is sized sufficiently large (e.g., 2.2 kilohms) so as not to present so great a load upon the bootstrapping circuit. Thus, once inverter operation commences, protection circuit 400 has no effect on the continued operation of inverter 200.

If, on the other hand, a ground fault condition is present at first output connection 302 prior to inverter start up, the following events occur. As previously discussed, once AC power is initially applied to ballast 10, the voltage between circuit ground 60 and earth ground is low frequency (e.g., 60 hertz) half-wave rectified AC. More specifically, during the negative half-cycles of the voltage provided by AC source 20 (i.e., when a negative voltage exists between first input terminal 102 and second input terminal 104; equivalently, when a positive voltage exists between second input terminal 104 and first input terminal 102), the lower left-hand diode in bridge rectifier 110 is forward-biased and the voltage between earth ground (i.e., the neutral wire at the lower end of AC source 20) and circuit ground 60 has a positive polarity. Consequently, under a fault condition wherein first output connection 302 is connected to earth ground, a positive current flows up from earth ground, into first output connection 302, through resonant inductor 320, into input 402, through resistors 420,440, into circuit ground 60, through the lower left-hand diode of bridge rectifier 102, out of first input terminal 102, through AC source, and back to the neutral wire of AC source 20 (which is at the same potential as earth ground). This positive current produces sufficient voltage (e.g., greater than 0.7 volts) across resistor 440 to activate transistor 450. With transistor 450 turned on, DC supply input 232 is coupled to circuit ground 60 via resistor 460. Because resistor 460 has a resistance (e.g., 2.2 kilohms) that is very low relative to that of resistor 240 (e.g., 220 kilohms), the voltage across capacitor 250 is limited to a low value that is less than the start up threshold of drive circuit 230. Transistor 450 will be on during only the negative half-cycles of the AC source voltage (during the positive half-cycles of the AC source voltage, the voltage between earth ground and circuit ground 60 is negative, and thus incapable of keeping transistor 450 on), but that is still sufficient (provided that the RC time constant of resistor 240 and capacitor 250 is sufficiently large) to prevent the voltage across capacitor 250 from reaching the start up threshold. In this way, inverter 200 is prevented from starting when an earth ground fault condition is present at output connection 302 prior to inverter start up.

It should be appreciated that protection circuit 400 does not necessarily require a true short (i.e., zero ohm impedance) between first output connection 302 and earth ground in order to prevent inverter start up. For example, with the component values discussed above, protection circuit 400 will prevent inverter start up as long as the impedance between first output connection 302 and earth ground is less than about 100,000 ohms. Given that inverter damage may occur even for earth ground faults in which there is a substantial impedance between first output connection 302 and earth ground, this added capability of protection circuit 400 is a potentially significant advantage.

Figure 2:
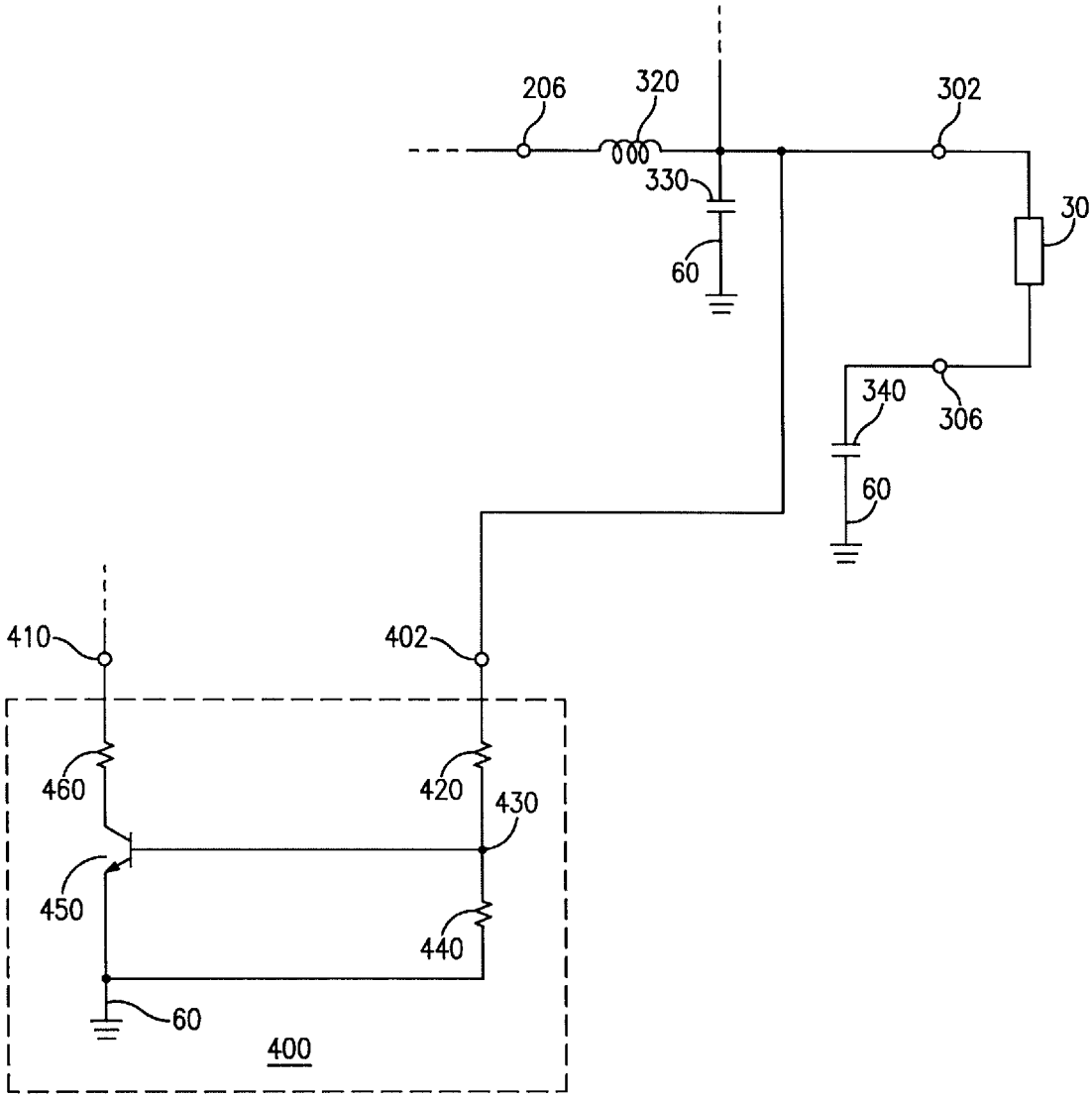
FIG. 2 describes a ballast with a half-bridge inverter and a protection circuit for preventing inverter start up during an output-to-ground fault involving the first output connection, in accordance with a second preferred embodiment of the present invention.

Turning now to FIG. 2, in a second preferred embodiment of the present invention, protection circuit 400 is configured in substantially the same manner as previously described with reference to FIG. 1, except that input 402 is coupled to first output connection 302 instead of inverter output 206. Even with this modification, the operation of protection circuit 400 remains substantially unchanged from that which was previously described. More specifically, because the voltage that exists between circuit ground 60 and earth ground is low frequency (e.g., 60 hertz) half-wave rectified AC, the impedance of resonant inductor 320 is negligible compared to that of resistor 420. Thus, it makes no significant functional difference whether input 402 is coupled to inverter output 206 (as in FIG. 1) or first output connection 302 (as in FIG. 2); either way, protection circuit 400 will respond to occurrence of an earth ground fault at first output connection 302. However, because the maximum voltage at first output connection 302 is (due to resonant voltage gain that occurs prior to ignition of lamp 30) substantially greater than the maximum voltage at inverter output 206, it may be necessary to increase the voltage rating of resistor 420 accordingly if the embodiment of FIG. 2 is employed.

Figure 3:
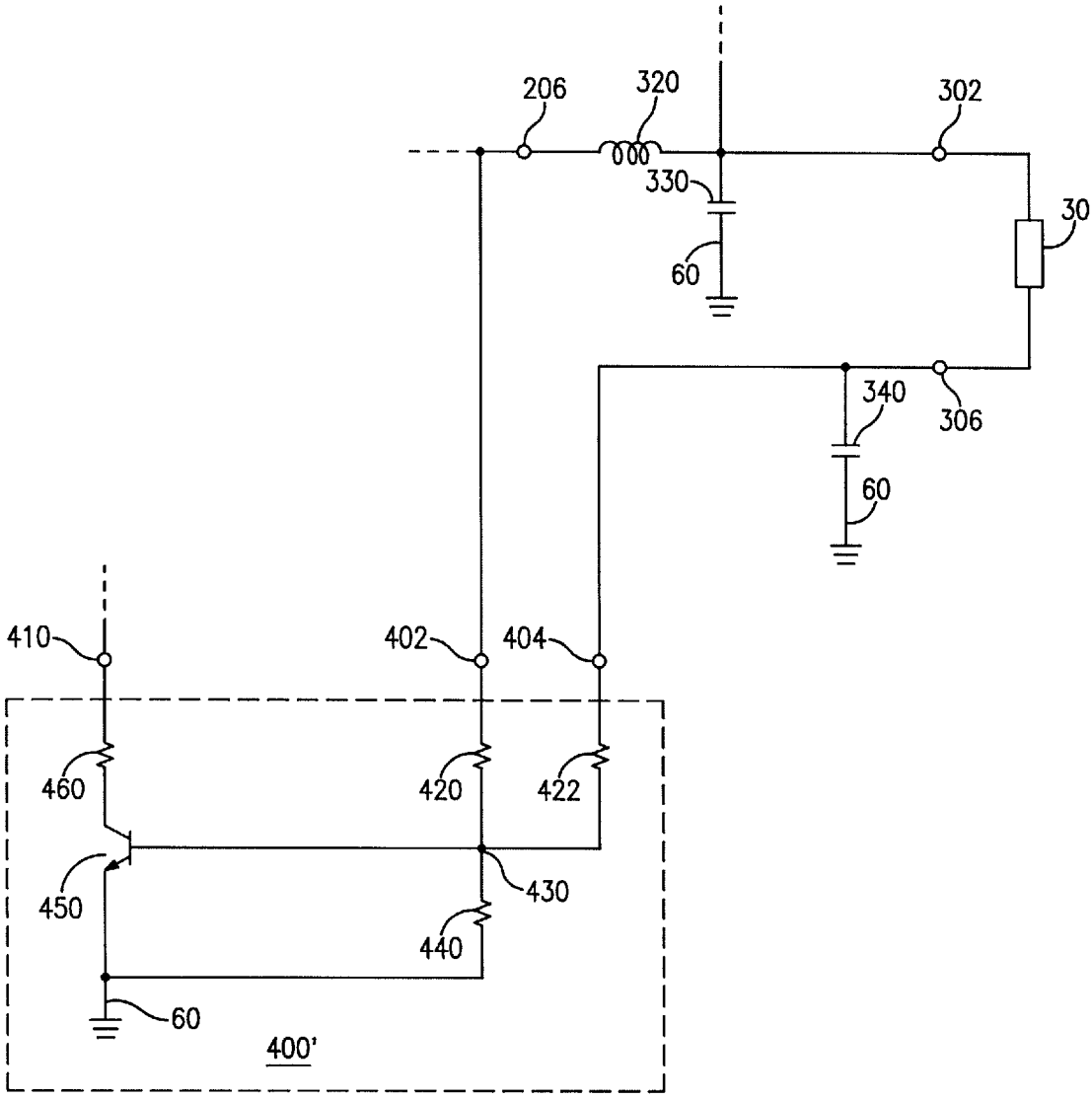
FIG. 3 describes a ballast with a half-bridge inverter and a protection circuit for preventing inverter start up during an output-to-ground fault involving a first output connection or a second output connection, in accordance with a third preferred embodiment of the present invention.

Referring now to FIG. 3, in a third preferred embodiment of the present invention, protection circuit 400' includes a second input 404 and a fourth resistor 422, in addition to the components present in protection circuit 400 in FIG. 1. Second input 404 is coupled to second output connection 306. Fourth resistor 422 is coupled between second input 404 and first node 430. The addition of fourth resistor 422 allows protection circuit 400' to monitor both output connections 302,306 and correspondingly prevent the inverter from starting if an earth ground fault is present at either (or both) of the output connections 302,306.

Because resistor 422 is coupled, via input 404, to DC blocking capacitor 340 (which, during operation of lamp 30, has a large positive DC voltage across it all of the time), it is likely that transistor 450 will remain on all of the time after lamp 30 begins to operate following inverter start up. This should be contrasted with what was previously described with reference to the circuit of FIG. 1, where it was explained that transistor 450 will turn on and off at a high frequency rate (when input 402 is coupled to inverter output 206). Although this behavior in the circuit of FIG. 3 does not impact the desired functionality of protection circuit 400' in preventing inverter start up under an output ground fault condition, it is relevant from a design standpoint because the designer must be sure that resistor 460 is large enough so as not to present an unduly large load that interferes with proper bootstrapping during normal operation of the inverter.

Although not explicitly shown in the drawings, it should be appreciated that first resistor 420 in FIG. 3 may alternatively be coupled to first output connection 302 rather than inverter output 206, along the same lines as previously discussed, without substantially affecting the desired operation of protection circuit 400'.

Figure 4:
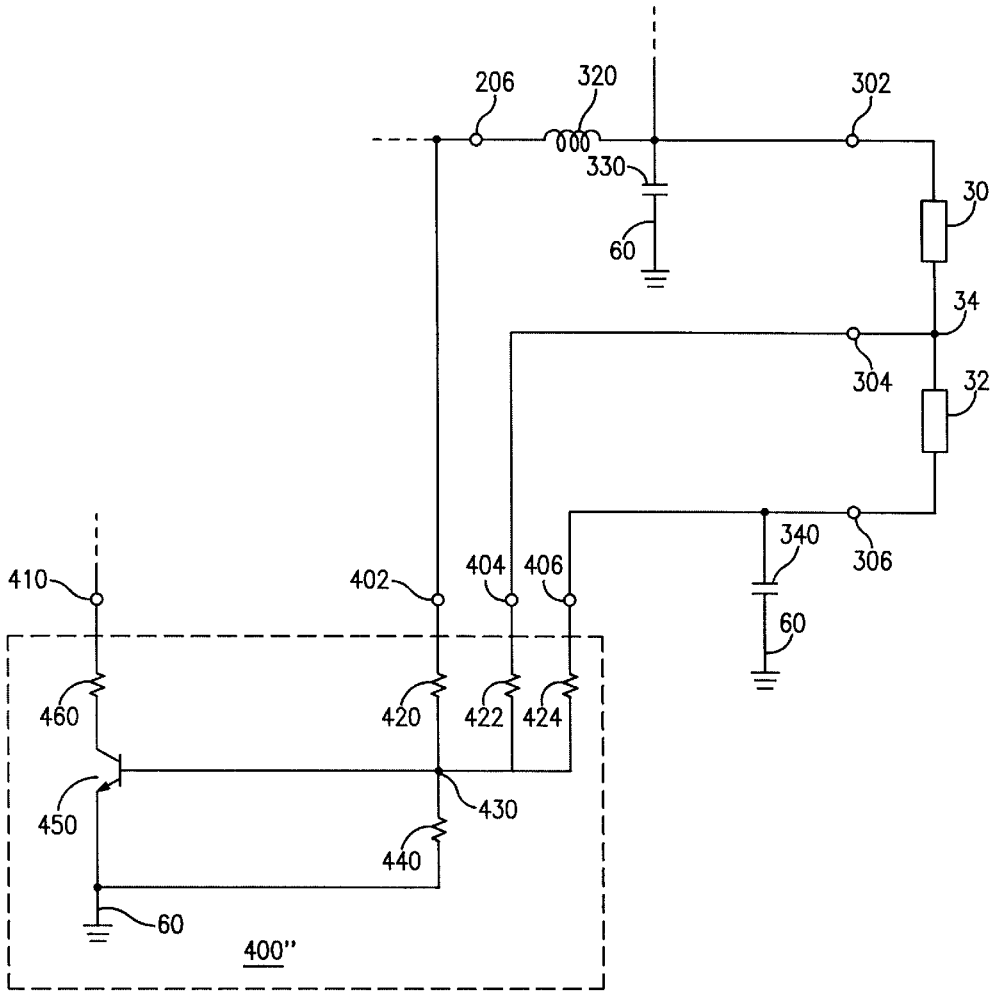
FIG. 4 describes a ballast with a half-bridge inverter and a protection circuit for preventing inverter start up during an output-to-ground fault involving a first output connection or a second output connection or a third output connection, in accordance with a fourth preferred embodiment of the present invention.

Turning now to FIG. 4, in a fourth preferred embodiment that is suited for a ballast that powers a lamp load comprising two lamps 30,32, protection circuit 400" includes three resistors 420,422,424, each of which is coupled to a corresponding output connection 302,304,306. More specifically, the output circuit includes first, second, and third output connections 302,304,306. First and second output connections 302,304 are adapted for connection to a first lamp 30, while second and third output connections 304,306 are adapted for connection to a second lamp 32. Second output connection 304 is coupled to a junction 34 between first lamp 30 and second lamp 32. Protection circuit 400" includes first, second, and third inputs 402,404,406, and first, fourth, and fifth resistors 420,422,424. First input 402 is coupled to inverter output 206. Second input 404 is coupled to second output connection 304. Third input is coupled to third output connection 306. First resistor 420 is coupled between first input 402 and first node 430. Fourth resistor 422 is coupled between second input 404 and first node 430. Finally, fifth resistor 406 is coupled between third input 406 and first node 430.

In the circuit of FIG. 4, protection circuit 400" monitors all three output connections 302,304,306 and correspondingly prevents the inverter from starting if an earth ground fault is present at any one (or any pair, or all three) of the output connections 302,304,306. As previously discussed, first input 402 may alternatively be coupled to first output connection 302 (rather than inverter output 206) without affecting the desired operation of protection circuit 400".

It should be appreciated that protection circuit 400" may be further modified, in like fashion, to accommodate more than two lamps (i.e., more than three output connections) simply be adding additional inputs and resistors to protection circuit 400".

Figure 5:
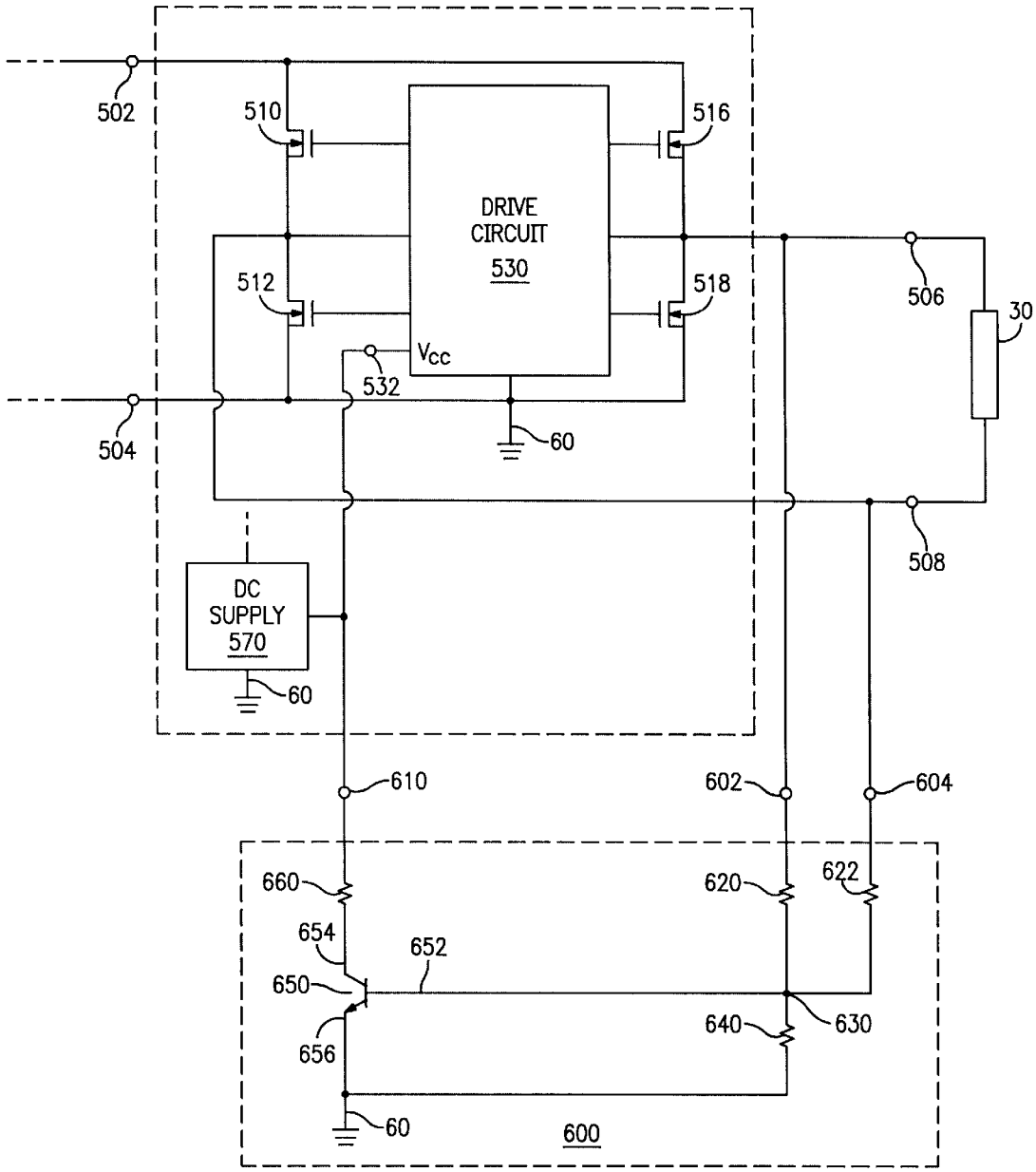
FIG. 5 describes a ballast with a full-bridge inverter and a protection circuit for preventing inverter start up during an output-to-ground fault involving a first output connection or a second output connection, in accordance with a fifth preferred embodiment of the present invention.

Turning now to FIG. 5, in a fifth preferred embodiment of the present invention, inverter 500 is a full-bridge inverter comprising first and second input terminals 502,504, first and second output terminals 506,508, first, second, third, and fourth inverter switches 510,512,516,518, a drive circuit 530, and a DC supply 570. Input terminals 502,504 are intended for connection to either a rectifier or a rectifier followed by a boost converter. Output terminals 506,508 are adapted for connection to a lamp load comprising at least one gas discharge lamp 30. First inverter switch 510 is coupled between first input terminal 502 and second output terminal 508. Second inverter switch 512 is coupled between second output terminal 508 and circuit ground 60. Third inverter switch 516 is coupled between first input terminal 502 and first output terminal 506. Fourth inverter switch 518 is coupled between first output terminal 506 and circuit ground 60. Drive circuit 530 is coupled to each of the inverter switches 510,512,516,518, and includes a DC supply input 532. During operation, drive circuit 530 turns each opposing pair of inverter switches (i.e., switches 510,518 are one pair, switches 512,516 are the other pair) on and off in a substantially complementary fashion and preferably at a high frequency rate in excess of 20,000 hertz. Drive circuit 530 initially turns on when the voltage at DC supply input 532 exceeds a start up threshold (e.g., 10 volts), and remains on as long as the voltage at DC supply input 532 remains above a turn-off threshold (e.g., 8 volts). DC supply 570, which is coupled to DC supply input 532, provides energy for initiating operation of drive circuit 530 and maintaining operation of drive circuit 530 after inverter switching commences.

Protection circuit 600 includes a first input 602 coupled to first output terminal 506, a second input 604 coupled to second output terminal 508, and an output 610 coupled to DC supply input 532 of drive circuit 530. During operation, protection circuit 600 prevents inverter 500 from starting if either one, or both, of output terminals 506,508 is shorted to earth ground.

As described in FIG. 5, protection circuit 600 includes a first resistor 620, a second resistor 622, a third resistor 640, an electronic switch 650, and a fourth resistor 660. First resistor 620 is coupled between first input 602 and a first node 630. Second resistor 622 is coupled between second input 604 and first node 630. Third resistor 640 is coupled between first node 630 and circuit ground 60. Electronic switch 650 is preferably implemented as a NPN bipolar junction transistor having a base 652, a collector 654, and an emitter 656. Base 652 is coupled to first node 630. Emitter 656 is coupled to circuit ground 60. Fourth resistor 660 is coupled between output 610 and the collector 654 of transistor 650.

The detailed operation of protection circuit 600 is substantially similar to that which was previously described with reference to the other preferred embodiments disclosed herein.

As previously discussed with reference to FIG. 1, resistor 240 and capacitor 250 function as a start up circuit for initially turning on drive circuit 230. In those applications where resistor 240 and capacitor 250 have suitably large values (e.g., 220 kilohms and 22 microfarads, respectively), the arrangement of FIG. 1 works well. If, however, resistor 240 and/or capacitor 250 are substantially lowered in value (e.g., to 120 kilohms and 2.2 microfarads, respectively) in order to accommodate "low-line" operation where the AC line voltage is considerably lower than its nominal value (e.g., 90 volts instead of the nominal 120 volts), it is possible that the inverter will start even if an output fault is present. More particularly, as previously discussed, when an output fault is present, transistor 450 will be on only during the negative half cycles of the AC line voltage. However, with resistor 240 coupled to a source of full-wave rectified AC voltage, capacitor 250 will be allowed to charge up during the positive half cycles when transistor 450 is off. If the RC time constant of resistor 240 and capacitor 250 is very short (i.e., small enough to allow the voltage across capacitor 250 to reach the start up threshold of 10 volts during one positive half-cycle), the inverter may momentarily start even if an output fault is present. The possibility of this occurring becomes even greater when operating under a "high line" condition where the AC line voltage may exceed its nominal value by as much as twenty percent (e.g., 144 volts instead of the nominal 120 volts). Although increasing the resistance of resistor 240 and/or the capacitance of capacitor 250 may solve the problem, that is not a feasible design option; for example, the resistance of resistor 240 must be low enough to ensure normal inverter start up under low-line conditions.

In order to properly solve this problem, and thereby ensure that the inverter does not start up when a fault is present at the ballast output, the start up circuit may be modified by changing the connection of the start up resistor. More specifically, in a sixth preferred embodiment as described in FIG. 6, start up resistor 242 is coupled to the second input terminal 104 of rectifier circuit 100 (as opposed to the arrangement in FIG. 1, in which start up resistor 240 is coupled to the first output terminal 106). Because the voltage between input terminal 104 and circuit ground 60 is half-wave rectified AC that is substantially in phase with the voltage that activates transistor 450 when an output fault is present, resistor 242 will supply charging current to capacitor 250 only during the same half of the AC line cycle as the fault signal. Thus, when transistor 450 is off, no charging current is provided to capacitor 250, and when transistor 450 is on, charging current flows through resistor 242 but capacitor 250 is prevented from charging up. In this way, inverter start up is prevented under a fault condition, even if the RC time constant of resistor 242 and capacitor 250 is very short.

Figure 6:
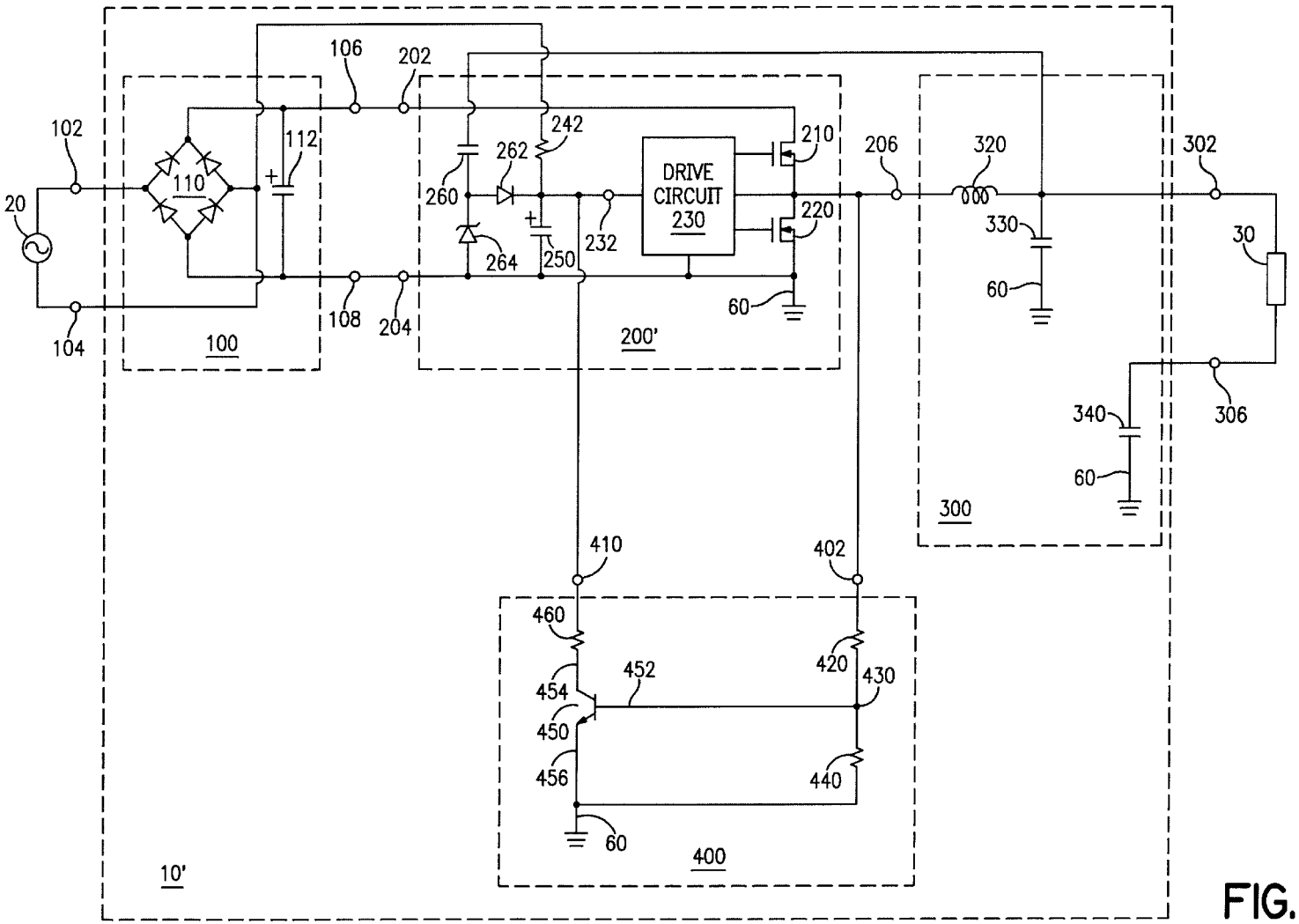
FIG. 6 describes a ballast with a with a half-bridge inverter and a protection circuit for preventing inverter start up during an output-to-ground fault involving a first output connection, in accordance with a sixth preferred embodiment of the present invention.

In a prototype ballast configured substantially as shown in FIG. 6, the components of protection circuit 400, and selected components of the DC supply circuit of inverter 200', were sized as follows:

Resistor 242: 120 kilohms
Capacitor 250: 2.2 microfarads
Resistor 420: 200 kilohms
Resistor 440: 10 kilohms
Transistor 450: 2N3904
Resistor 460: 4.7 kilohms The modified start up circuit described in FIG. 6 is equally applicable to the embodiments previously described with reference to FIGS. 2–5.

Although the present invention has been described with reference to certain preferred embodiments, numerous modifications and variations can be made by those skilled in the art without departing from the novel spirit and scope of this invention. For example, although the preferred embodiments disclosed herein describe inverters 200,500 as a driven-type inverter, it should be understood that inverter need not be a driven-type inverter, and that protection circuits 400, 400', 400" may be used in conjunction with a self-oscillating type inverter (e.g., to prevent triggering of a diac in a diac-based inverter starting circuit). As another example, although all of the preferred embodiments disclosed herein relate to a discrete circuit implementation of protection circuits 400, 400', 400", it should be appreciated that each protection circuit may alternatively by realized using a non-discrete means, such as a microcontroller or custom integrated circuit along with peripheral components that is programmed or configured to provide the input/output functionality of protection circuits 400, 400', 400" as described herein.

What is claimed is:

1. A ballast for powering a gas discharge lamp load, comprising:

a circuit ground having a nonzero average voltage with respect to earth ground;

an inverter having a DC voltage supply and an inverter output, wherein the inverter is operable to commence operation when a voltage provided by the DC voltage supply reaches a predetermined start up threshold;

first and second output connections adapted for connection to the gas discharge lamp load;

a protection circuit coupled to the DC voltage supply of the inverter, the circuit ground, and one of: (i) the inverter output; and (ii) the first output connection, wherein the protection circuit is operable, in response to a fault wherein the first output connection is coupled to earth ground prior to start up of the inverter, to prevent start up of the inverter by preventing the voltage provided by the DC voltage supply from reaching the predetermined start up threshold.

2. The ballast of claim 1, wherein the protection circuit prevents start up of the inverter by coupling the DC voltage supply to the circuit ground.

3. The ballast of claim 1, wherein the protection circuit comprises:

an input coupled to one of: (i) the inverter output; and (ii) the first output connection;

an output coupled to the DC voltage supply of the inverter;

a first resistor coupled between the input and a first node;

a second resistor coupled between the first node and the circuit ground;

an electronic switch having a collector, a base coupled to the first node, and an emitter coupled to the circuit ground; and a third resistor coupled between the output and the collector of the electronic switch.

4. The ballast of claim 1, wherein the protection circuit is operable to prevent start up of the inverter when the first output connection is coupled to earth ground via an impedance of less than about 100,000 ohms.

5. The ballast of claim 1, wherein:

the protection circuit is further coupled to the second output connection; and the protection circuit is further operable, in response to a fault wherein the second output connection is coupled to earth ground prior to start up of the inverter, to prevent start up of the inverter by preventing the voltage provided by the DC voltage supply from reaching the predetermined start up threshold.

6. The ballast of claim 5, wherein the protection circuit prevents start up of the inverter by coupling the DC voltage supply to the circuit ground.

7. The ballast of claim 5, wherein the protection circuit comprises:

a first input coupled to one of:
(i) the inverter output; and
(ii) the first output connection;

a second input coupled to the second output connection;

an output coupled to the DC voltage supply of the inverter;

a first resistor coupled between the first input and a first node;

a second resistor coupled between the first node and the circuit ground;

an electronic switch having a collector, a base coupled to the first node, and an emitter coupled to the circuit ground;

a third resistor coupled between the output and the collector of the electronic switch; and a fourth resistor coupled between the second input and the first node.

8. The ballast of claim 5, wherein the protection circuit is operable to prevent start up of the inverter when at least one of the first and second output connections is coupled to earth ground via an impedance of less than about 100,000 ohms.

9. The ballast of claim 5, wherein:

the ballast further comprises a third output connection adapted for connection to the gas discharge lamp load;

the protection circuit is further coupled to the third output connection; and the protection circuit is further operable, in response to a fault wherein the third output connection is coupled to earth ground prior to start up of the inverter, to prevent start up of the inverter by preventing the voltage provided by the DC voltage supply from reaching the predetermined start up threshold.

10. The ballast of claim 9, wherein the protection circuit prevents start up of the inverter by coupling the DC voltage supply to the circuit ground.

11. The ballast of claim 9, wherein the protection circuit comprises:

a first input coupled to one of:
(i) the inverter output; and
(ii) the first output connection;

a second input coupled to the second output connection;

a third input coupled to the third output connection;

an output coupled to the DC voltage supply of the inverter;

a first resistor coupled between the first input and a first node;

a second resistor coupled between the first node and the circuit ground;

an electronic switch having a collector, a base coupled to the first node, and an emitter coupled to the circuit ground;

a third resistor coupled between the output and the collector of the electronic switch;

a fourth resistor coupled between the second input and the first node; and a fifth resistor coupled between the third input and the first node.

12. The ballast of claim 9, wherein the protection circuit is operable to prevent start up of the inverter when at least one of the first, second, and third output connections is coupled to earth ground via an impedance of less than about 100,000 ohms.

13. The ballast of claim 1, wherein the ballast further comprises an output circuit, comprising:

a resonant inductor coupled between the inverter output and the first output connection;

a resonant capacitor coupled between the first output connection and the circuit ground; and a direct current (DC) blocking capacitor coupled between the second output connection and the circuit ground.

14. The ballast of claim 1, further comprising a full-wave rectifier circuit, comprising:

first and second input terminals adapted to receive a source of alternating current, wherein the second input terminal is at the same electrical potential as earth ground; and first and second output terminals coupled to the inverter, wherein the second output terminal is coupled to the circuit ground.

15. The ballast of claim 14, wherein the DC voltage supply includes a start up resistor coupled to a source of full-wave rectified alternating current.

16. The ballast of claim 14, wherein the DC voltage supply includes a start up resistor coupled to the first input terminal of the inverter.

17. The ballast of claim 14, wherein the DC voltage supply includes a start up resistor coupled to a source of half-wave rectified alternating current.

18. The ballast of claim 14, wherein the DC voltage supply includes a start up resistor coupled to the second input terminal of the full-wave rectifier circuit.

19. The ballast of claim 14, wherein the rectifier circuit is operable to provide a half-wave rectified AC voltage between the second output terminal and earth ground.

20. A ballast for powering a gas discharge lamp load, comprising:

a full-wave rectifier circuit, comprising:

first and second input terminals adapted to receive a conventional source of alternating current (AC); and first and second output terminals, wherein:

the second output terminal is coupled to a circuit ground node; and a half-wave rectified AC voltage is present between the circuit ground node and earth ground;

an inverter, comprising:

first and second input terminals coupled to the first and second output terminals of the rectifier circuit;

an inverter output;

a first inverter switch coupled between the first input terminal and the inverter output;

a second inverter switch coupled between the inverter output and the circuit ground node;

a driver circuit coupled to the first and second inverter switches and operable to commutate the inverter switches in a substantially complementary fashion, the driver circuit including a DC supply input and operable to commence commutation of the inverter switches when a voltage at the DC supply input exceeds a predetermined start up threshold; and a DC supply circuit coupled to, and operable to provide the voltage at, the DC supply input of the driver circuit;

an output circuit coupled to the inverter output, the output circuit including first and second output connections adapted for connection to the gas discharge lamp load; and a protection circuit, comprising:

a first input coupled to one of:

(i) the inverter output; and (ii) the first output connection;

an output coupled to the DC supply input of the driver circuit;

a first resistor coupled between the input and a first node;

a second resistor coupled between the first node and the circuit ground;

an electronic switch having a collector, a base coupled to the first node, and an emitter coupled to the circuit ground; and a third resistor coupled between the output and the collector of the electronic switch.

21. The ballast of claim 20, wherein the protection circuit further comprises:

a second input coupled to the second output connection; and a fourth resistor coupled between the second input and the first node.

22. The ballast of claim 21, wherein:

the output circuit further comprises a third output connection adapted for connection to the gas discharge lamp load; and the protection circuit further comprises:

a third input coupled to the third output connection; and a fifth resistor coupled between the third input and the first node.

23. The ballast of claim 20, wherein the DC voltage supply includes a start up resistor coupled to one of:

(i) the first output terminal of the full-wave rectifier circuit;

(ii) the first input terminal of the inverter; and (iii) the second input terminal of the full-wave rectifier circuit.

24. A ballast for powering a gas discharge lamp load, comprising:

a full-wave rectifier circuit, comprising:

first and second input terminals adapted to receive a conventional source of alternating current (AC); and first and second output terminals, wherein:

the second output terminal is coupled to a circuit ground node; and a half-wave rectified AC voltage is present between the circuit ground node and earth ground;

an inverter, comprising:

first and second input terminals coupled to the first and second output terminals of the rectifier circuit;

first and second output terminals adapted for connection to the gas discharge lamp load;

a first inverter switch coupled between the first input terminal and the second output terminal;

a second inverter switch coupled between the second output terminal and the circuit ground node;

a third inverter switch coupled between the first input terminal and the first output terminal;

a fourth inverter switch coupled between the first output terminal and the circuit ground node;

a driver circuit coupled to the first, second, third, and fourth inverter switches and operable to commutate the inverter switches, the driver circuit including a DC supply input and operable to commence commutation of the inverter switches when a voltage at the DC supply input exceeds a predetermined start up threshold; and a DC supply circuit coupled to, and operable to provide the voltage at, the DC supply input of the driver circuit;

a protection circuit, comprising:

a first input coupled to the first output terminal of the inverter;

an output coupled to the DC supply input of the driver circuit;

a first resistor coupled between the input and a first node;

a second resistor coupled between the first node and the circuit ground;

an electronic switch having a collector, a base coupled to the first node, and an emitter coupled to the circuit ground; and a third resistor coupled between the output and the collector of the electronic switch.

25. The ballast of claim 24, wherein the protection circuit further comprises:

a second input coupled to the second output terminal of the inverter; and a fourth resistor coupled between the second input and the first node.

26. The ballast of claim 24, wherein the DC voltage supply includes a start up resistor coupled to one of:

(i) the first output terminal of the full-wave rectifier circuit;

(ii) the first input terminal of the inverter; and (iii) the second input terminal of the full-wave rectifier circuit.

* * * * *